United States Patent [19]

Staub et al.

[11] Patent Number: 4,735,734

[45] Date of Patent: Apr. 5, 1988

[54] PROCESS FOR PREPARING SUSPENSIONS OF SOLID LUBRICANTS

[75] Inventors: Hans-Rudolf Staub, Eggenwil; Hansjörg Furrer, Ziefen, both of Switzerland

[73] Assignee: Lonza Ltd., Gampel, Switzerland

[21] Appl. No.: 910,724

[22] Filed: Sep. 23, 1986

[30] Foreign Application Priority Data

Oct. 2, 1985 [CH] Switzerland ..... 4249/85

[51] Int. Cl.[4] ..... C10M 125/02

[52] U.S. Cl. ..... 252/29; 252/22; 252/49.5; 252/56 R

[58] Field of Search ..... 252/22, 23, 29, 30, 252/49.5

[56] References Cited

U.S. PATENT DOCUMENTS

| | | | |
|---|---|---|---|
| 2,176,879 | 10/1939 | Bartell | 252/22 |
| 3,198,735 | 8/1965 | Lamson et al. | 252/30 |
| 3,242,075 | 3/1966 | Hunter | 252/22 |
| 3,341,454 | 9/1967 | Chor et al. | 252/22 |
| 3,384,580 | 5/1968 | Peace | 252/29 |
| 3,472,770 | 10/1969 | Preston et al. | 252/23 |
| 3,833,502 | 9/1974 | Leary et al. | 252/49.5 |
| 3,983,042 | 9/1976 | Jain et al. | 252/49.5 |
| 4,050,932 | 9/1977 | Lemmer | 252/30 |
| 4,052,323 | 10/1977 | Feneberger et al. | 252/23 |
| 4,104,178 | 8/1978 | Jain et al. | 252/30 |
| 4,321,295 | 3/1982 | Smith-Johannsen | 252/29 |
| 4,575,430 | 3/1986 | Périard et al. | 252/29 |

FOREIGN PATENT DOCUMENTS

| | | |
|---|---|---|
| 596294 | 10/1977 | Switzerland . |
| 609728 | 3/1979 | Switzerland . |

*Primary Examiner*—William R. Dixon, Jr.
*Assistant Examiner*—Ellen McAvoy
*Attorney, Agent, or Firm*—Fisher, Christen & Sabol

[57] ABSTRACT

Solid lubricants which are used in the non-cutting hot forming of metals. Lubricants containing graphite and polymers are presuspended in a colloid mill in water as a carrier liquid and immediately thereafter are subjected to a further mixing process in an intensive mixer, thereby being processed to a stable suspension.

11 Claims, 1 Drawing Sheet

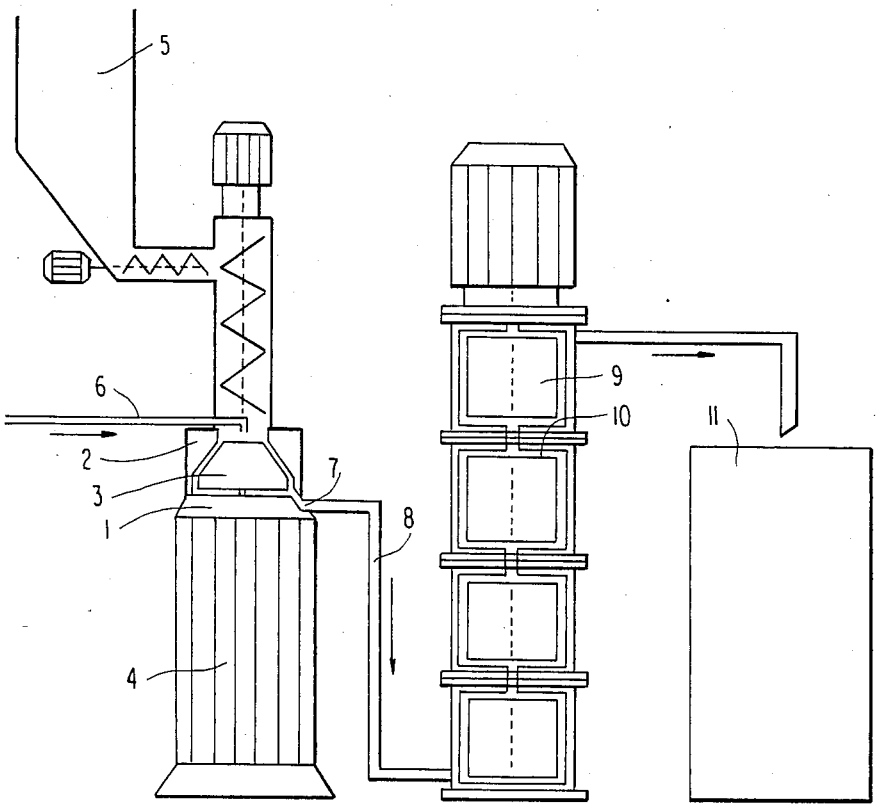
FIGURE

PROCESS FOR PREPARING SUSPENSIONS OF SOLID LUBRICANTS

BACKGROUND OF THE INVENTION

1. Field Of The Invention

The invention relates to a process for the suspending of solid lubricants, which are used in non-cutting hot forming of metals, lubricants containing graphite and polymers in water as a carrier liquid.

2. Prior Art

From Swiss Published Patent Specification Nos. 596,294 and 609,728, solid lubricants are known for the non-cutting forming of metals at high temperatures. Such lubricants contain graphite, polymers, suspension auxiliary agents and optionally other auxiliary agents, such as bactericides, which form a suspension with water. The addition of bactericides is necessary to avoid a bacterial decomposition of the suspending of solid lubricant suspension during storage; the suspension auxiliary agents serve the purpose of keeping the liquid and solid constitutents in homogeneous mixture over longer periods. The solid lubricant suspension is consumed during processing, i.e., the water on the tool of the workpieces evaporates and the polymer portion burns off. In the processing of the solid lubricants, the bacterial additions also are subjected to evaporation, which in view of their possible toxicity is undesirable and, together with the suspension auxiliary agents, form an undesirable, non-lubricating part of the solid lubricant formulation.

BRIEF DESCRIPTION OF THE INVENTION

The main object of the invention is to provide a process for producing a homogeneous, stable, solid lubricant suspension, containing a carrier liquid, such as water, graphite and polymers, directly at the site of use, without the addition of bactericides and with a suspension auxiliary agent content which is as small as possible. This is achieved according to the invention by the fact that the constitutents of the solid lubricant and water as carrier liquid are presuspended in a colloid mill and immediately thereafter are subjected to a further mixing process in an intensive mixer and are thus processed to a stable suspension.

For performing the process, the dry, premixed constitutents of the solid lubricant and water can be brought together in a colloid mill. By the phrase "dry, premix constitutents" is meant the mixture of graphite, polymer and optional additions, such as suspension auxiliary agents, film stabilizers, optionally also wetting agents and inorganic additives.

Additives such as wetting agents, solvents, film-forming agents, pH stabilizer, soluble inorganic salts (e.g., phosphates), etc., have already been added to the water.

In a further embodiment of the invention, the water and optionally with the named additives, such as suspension auxiliary agents, wetting agents, solvents, etc., together with the polymer, e.g., as a plastic dispersion, are premixed and then the mixture is fed into the colloid mill with the graphite, which is optionally homogeneously mixed, e.g., with suspension auxiliary agents, film stabilizers, etc.

Actually commercially available apparatus can be used as the colloid mill, whereby adjustments can be necessary for the special purpose and in view of the properties of the products to be produced. Such adjustments include the dimensioning of the drive powder conveyers, liquid and powder intakes and valves, strippers and switching devices. The clearance between the rotor and housing should be 0.01 to 3 mm and the peripheral speed, calculated from the rotor periphery and revolutions, should be 10 to 40 m/sec.

According to the process of the invention, suspensions with a solid content of 1 to 70 percent by weight can be produced. The possibility of attaining such high solid contents was all the more surprising since the individual constitutents of the solid lubricant exhibit very low bulk densities. For graphite, such densities are 0.2 to 0.5 kg/l, for the polymers and additives, they are 0.2 to 0.7 kg/l, and for a typical dry mixture, they are 0.2 to 0.5 kg/l. Thus, for a 25 percent by weight suspension, the volume of the solid lubricant is already greater than the volume of the water necessary for production of the suspension.

With the use of the colloid mill according to the invention, one can reliably avoid a lumping of the solid. The residue time of the components in the mixing area of the colloid mill is advantageously in the range of 0.01 to 5 seconds.

However, the stability of suspensions so produced is limited and the solids quickly settle. An immediate reprocessing of the suspension in an intensive mixer, which has an average residence time of 60 to 3000 sec., preferably 150 to 300 sec., provides stable suspensions.

Suitable intensive mixers are advantageously mixers with at least a co-rotating agitator blade shaft or counter-rotating agitator blade shafts, agitator ball mills, jet mixers or screw mixers, preferably in cascade arrangement. If the constitutents, such as the solid lubricant and water, for example, were mixed only in an intensive mixer for the solid lubricant suspension, a lumping and inhomogeneity in the suspension can neither be prevented nor eliminated.

By this arrangement, according to the invention, of connecting a colloid mill and intensive mixer downstream from one another, it is possible to obtain from the carrier liquid and the solids a completely lump-free, homogeneous solid suspension, whose constituents are completely wet and, to the extent that they are suitable for the purpose, are decomposed. A suspension produced in this way is lump-free and has a considerably extended residence time, measured against the type and amount of the suspension auxiliary agent, and a sedimentation of the solids occurs only after considerably longer times than would be possible in the case of a mixing and suspending with only one of the mixers placed one after the other according to the invention.

BRIEF DESCRIPTION OF THE DRAWINGS

In the drawings, the FIGURE is a diagram of the device of the invention.

DETAILED DESCRIPTION OF THE INVENTION

The solid lubricants to be used in the process of the invention are known, e.g., from Swiss Published Patent Specification Nos. 596,294 and 609,728. Accordingly, the initial materials to be used are at least a solid lubricant, preferably graphite, especially those graphites with a high purity, for example over 90 percent, and an average grain size of not more than 300 micrometers. The best results can be obtained with graphite of 96 to 99.5 percent purity and an average grain size of 100 micrometers. Optionally, molybdenum disulfide, $CaF_2$ or BN alone or in mixture with graphite analogously in the framework of this invention can be used.

The useful polymers are the organic products which decompose residue-free in heat, and are, for example, alkylene homopolymers or copolymers. They include homo and copolymers of alkenes (monoolefins, diolefins, etc.), vinyl esters, vinyl alcohols, unsaturated dibasic acids and esters (dicarboxylic acids and esters), alkyl esters and acyclic acids and esters. The alkylene homopolymer or copolymer can be, for example, polyethylene, polymethyl methacrylate, polystyrene, polybutadiene, polyvinyl acetate, polyvinyl propionate, a copolymer of methyl methacrylate and styrene, a copolymer of methyl methacrylate and alphamethyl styrene, polydiallyl phthalate, polypropylene, a copolymer of styrene and butadiene, polymethyl methacrylate, a copolymer of vinyl acetate and dibutyl maleate, a copolymer of vinyl acetate and ethylene and polyisobutylene.

The useful suspension auxiliary agents materials include polysaccharides, such as, starches, celluloses, inulin, glycogen, agar, levan, diquinone, pectin, lignin and araban, alkylcellulloses, such as, methyl, ethyl, propyl and butyl celluloses, alginates, such as, sodium alginate, potassium alginate, propyleneglycol alginate and ammonium alginate, and mixtures of such substances.

The homogeneous aqueous dispersion should contain 1 to 70 percent by weight of the solid lubricant and exhibit a viscosity of 100 to 30000 cp at 5° to 50° C. To achieve the desired viscosity for the dispersion, an organic stabilizer, optionally contained in the solid lubricant, can be adequate. But it is also possible to control the viscosity by a thickener or a mixture of thickeners. Of the series of suitable thickeners, e.g., water-soluble polysaccharides, alkylcelluloses, polyvinyl alcohols, polyarylates, polyvinylpyrrolidone, and optionally even inorganic substances, especially minerals, such as clays or silicic acid, are suitable.

Other additives can be inorganic additives and can be, for example, boron compounds, polyphosphates and alkali silicates, alone or in mixture with one another. Polyphosphates in insoluble or slightly soluble form also belong to this group. Preferably Madrell salts or Kurrol salts are used as the polyphosphates. In this case, there are involved compounds of the type $(NaPO_3)_n$, with n being 6 to 50,000, preferably 6 to 10,000. The boron compound can be used in soluble form or preferably in slightly soluble or insoluble form. Borax, boric acid, $B_2O_3$, $KB_5O_84.H_2O$ or zinc borate can be used as the boron compound. The applicable alkali silicate to be used is preferably a sodium silicate or potassium silicate with an $SiO_2$ content of between 21 and 47 percent.

For reliable wetting of the powdery solid lubricant mixture, it can be helpful to add a wetting agent to the mixture and/or water. Examples of such wetting agents are alkylaryl sulfonates, fatty acid amines, soaps from fats, substituted amides of alkyl phosphates, sulfonated esters of dicarboxylic acids, sulfonated fatty amides, alkylamines, sodium alkyl sulfates, aliphatic amino esters, polyethers such as polyoxyethylene and polyoxypropylene, sulfonated high phenols and naphthalene sulfonates.

The solid lubricant suspensions to be produced according to the process of the invention can contain as solid components, for example, 1 to 90 percent by weight of solid lubricant, preferably graphite, 1 to 50 percent by weight of polymer, 1 to 80 percent by weight of inorganic additive and 0.2 to 80 percent by weight of an organic stabilizing agent.

Water is used as the carrier liquid. Optional additions to the water are, for example, wetting agents, solvents such as alcohols, esters, ketones and aldehydes. Such additions to the water can be necessary, for example, to quickly bring into suspension the solid lubricant and thus the graphite that is extremely difficult to wet, or to quickly solubilize or swell the polymer portion.

The solid lubricants are suitable for high-temperature application at temperatures of 300° to 1300° C., for example, for lubricating a tool, e.g., mandrel, mandrel rod or die and workpiece, for example, ball or pipe, in hot forming in the so-called "multiple pipe mills," continuous trains, pilger mills, Assel trains, push bench installations, extrusion presses or heading presses, and in rolling mill trains for shape and sheet rolling. The preferred materials available for working in this case are iron and steel.

The suspension produced according to the process of the invention is applied to the hot workpiece or hot tool or roll by spreading, brushing or preferably by spraying, whereby the carrier liquid, in this case water, and optional volatile additives evaporate and leave a water-resistant, graphite-containing melted film of polymer. The water resistance of the film is required to be able to cool the surface coated with the solid lubricant, if necessary.

The film-forming properties are the essential feature of the solid lubricant. These properties are shown not only at the use site, i.e., on the workpiece or tool, but also during mixing, i.e., in the contact of the solids and then especially of the polymers with the water. It is therefore all the more surprising that it is now possible according to the process of the invention to mix with water lump-free and homogeneous a material extremely difficult to wet, such as graphite, and a polymer with strongly film-forming to adhering properties, whereby the forming film must then be water-resistant. In the process, this is aggravated by the fact that the volume of the solids because of their low bulk density can exceed the volume of the water. Finally, the suspension, measured against the amount of the addition of suspension auxiliary agents, must be extremely stable and must not show any separation or sedimentation over longer periods.

The invention further comprises the device for embodying the process according to the invention, which consists of a colloid mill and an intensive mixer installed immediately downstream.

The colloid mill usually has a clearance of 0.01 to 3 mm and usually is operated with rotational speeds of 10 to 40 m/sec. The entire installation is advantageously designed for a throughput of 25 to 1200 kg/h and more preferably of 25 to 200 kg/h, of material. The FIGURE diagrammatically reproduces the device according to the invention. Colloid mill 1 consists essentially of housing 2 and rotor 3, which is put into motion by drive 4. From storage vessel 5 the graphite/polymer mixture or graphite alone, respectively with the other possible additives, and by feed 6 the water, optionally in mixture with the polymer and other optional additives, are fed into colloid mill 1. Immediately after discharge 7 of the colloid mill, by hose 8, the premixed suspension is fed into intensive mixer 9, (represented by way of illustration as a blade agitator 10 arranged in cascade form). After intensive mixer 9, storage vessel 11 can be provided which can be equipped with a filling level gauge to turn the installation on and off according to the filling level.

What is claimed is:

1. Process for preparing a suspension of at least one solid lubricant, which is used in the non-cutting hot-forming of metals, said lubricant containing graphite and at least one polymer in water as a carrier liquid, comprising suspending the constituents of the solid lubricant in the water in a colloid mill, said suspension having a solid lubricant content of 1 to 70 weight percent, said suspension containing 1 to 90 weight percent of graphite and 1 to 50 weight percent of at least one polymer and, water being present as a carrier liquid in an amount at least sufficient to allow said suspension of at least one solid lubricant to be formed, and immediately afterward are subjecting said suspension to a further mixing process in an intensive mixer, thereby processing said suspension to a stable suspension.

2. Process according to claim 1 wherein the dry premixed constituents of the solid lubricant and water are brought together in the colloid mill.

3. Process according to claim 1 wherein the graphite and the polymer premixed in the water are fed into the colloid mill.

4. Process according to claim 3 wherein the colloid mill exhibits a clearance of 0.01 to 3 mm.

5. Process according to claim 4 wherein the colloid mill is operated with a peripheral speed of 10 to 40 m/sec.

6. Process according to claim 5 wherein the residence time of the material being mixed in the intensive mixer is 60 to 3000 sec.

7. Process according to claim 1 wherein the colloid mill exhibits a clearance of 0.01 to 3 mm.

8. Process according to claim 1 wherein the colloid mill is operated with a peripheral speed of 10 to 40 m/sec.

9. Process according to claim 1 wherein the colloid mill is operated with a peripheral speed of 15 to 20 m/sec.

10. Process according to claim 1 wherein the residence time of the material being mixed in the intensive mixer is 60 to 3000 sec.

11. Process according to claim 1 wherein the residence time of the material being mixed in the intensive mixer is 150 to 300 sec.

* * * * *